US009955805B2

(12) United States Patent
Lou

(10) Patent No.: US 9,955,805 B2
(45) Date of Patent: May 1, 2018

(54) DUAL COMPARTMENT ZIPPER ADJUSTABLE PILLOW

(71) Applicant: Standard Fiber, LLC, Burlingame, CA (US)

(72) Inventor: Jing Lou, San Francisco, CA (US)

(73) Assignee: STANDARD FIBER, LLC, Burlingame, CA (US)

( * ) Notice: Subject to any disclaimer, the term of this patent is extended or adjusted under 35 U.S.C. 154(b) by 0 days. days.

(21) Appl. No.: 15/660,503

(22) Filed: Jul. 26, 2017

(65) Prior Publication Data

US 2018/0028002 A1 Feb. 1, 2018

Related U.S. Application Data

(60) Provisional application No. 62/368,628, filed on Jul. 29, 2016.

(51) Int. Cl.
*A47G 9/10* (2006.01)
*A47C 7/38* (2006.01)

(52) U.S. Cl.
CPC ..... *A47G 9/1081* (2013.01); *A47G 9/10* (2013.01); *A47C 7/383* (2013.01)

(58) Field of Classification Search
CPC ..... A47G 9/10; A47G 9/1081; A47G 9/109; A47G 9/0253; A47G 9/0238; A47C 7/383; A47C 7/38
USPC ..... 5/636, 637, 639, 640, 645, 630, 490
See application file for complete search history.

(56) References Cited

U.S. PATENT DOCUMENTS 4,756,035 A * 7/1988 Beier ..... A47G 9/1081 5/640
4,768,248 A * 9/1988 O'Sullivan ..... A47G 9/10 5/640
4,956,886 A * 9/1990 Sarkozi ..... A47G 9/10 5/636
5,020,174 A * 6/1991 Sarkozi ..... A47G 9/10 5/640
5,271,114 A * 12/1993 Kjersem ..... A47G 9/0253 5/490
5,363,524 A * 11/1994 Lang ..... A47G 9/10 5/640
5,535,467 A * 7/1996 Ciske ..... A47G 9/10 5/636

(Continued)

*Primary Examiner* — Robert G Santos
(74) *Attorney, Agent, or Firm* — Levenfeld Pearlstein, LLC

(57) ABSTRACT

A dual compartment zipper adjustable pillow includes a main body portion having front and rear panels having four sides, and sealed along three of the sides. The main body portion defines an interior space. A neck support portion is connected to the main body portion at a adjacent to the fourth side. A full open end zipper defines first and second zipper portions disposed on the main body portion front panel and openable to access the interior space. One half of a full open zipper defines a third zipper portion disposed on a rear side of the neck support portion. In dual compartment configuration, the neck support portion is outside of the main body portion interior space and the first and second zipper portions are closed to enclose the main body portion. In a single compartment configuration, the neck support portion is positioned in the main body portion interior and the first and third zipper portions are closed to enclose the main body portion.

16 Claims, 5 Drawing Sheets

(56) References Cited

U.S. PATENT DOCUMENTS

| | | | | | |
|---|---|---|---|---|---|
| 5,758,375 | A * | 6/1998 | Horowitz | A47G 9/10 | 5/640 |
| 5,920,933 | A * | 7/1999 | Chou | A47G 9/10 | 5/417 |
| 6,009,577 | A * | 1/2000 | Day | A47C 7/383 | 5/636 |
| 6,490,743 | B1 * | 12/2002 | Adat | A47G 9/0253 | 5/490 |
| 6,532,611 | B1 * | 3/2003 | Day | A47C 7/383 | 5/636 |
| 7,832,034 | B2 * | 11/2010 | Liu | A47G 9/10 | 5/490 |
| 8,234,733 | B1 * | 8/2012 | Fuss | A47C 16/00 | 5/637 |
| 8,276,227 | B2 * | 10/2012 | Pileggi | A47G 9/1081 | 5/630 |
| 2010/0077551 | A1 * | 4/2010 | Liu | A47G 9/0253 | 5/636 |
| 2011/0145994 | A1 * | 6/2011 | Pileggi | A47G 9/1081 | 5/655.3 |

* cited by examiner

DUAL COMPARTMENT ZIPPER ADJUSTABLE PILLOW

CROSS-REFERENCE TO RELATED APPLICATION DATA

This application claims the benefit of and priority to Provisional U.S. Patent Application Ser. No. 62/368,628, filed Jul. 29, 2016, the disclosure of which is incorporated herein in its entirety.

BACKGROUND

A pillow typically includes an outer layer or cover, such as a pillow shell, that defines an internal space configured to house a padding or filler material. Some pillows use a contoured foam filler, such as a one-piece foam filler member to provide a predetermined shape to the pillow. For example, a foam filler member may have larger or thicker front and rear sections and a thinner or smaller mid-section to cradle the user's head and support the user's neck. Such pillows are not, however adjustable in any manner.

Other pillows have sections or compartments into which filler material can added or removed to adjust the thickness or height of the pillow for maximum comfort. One drawback to these fillable pillows is that the fill must be stored and can be misplaced, making adjustments to the pillows difficult at best. Moreover, the length of the pillow or the distance across the upper back, neck and head that the pillow extends is fixed and cannot be varied.

Accordingly, there is a need for an adjustable pillow that allows the amount of filler material to be varied and that has an integral neck support. Desirably, such a pillow is configured having dual compartments such that length of the pillow is adjustable and the neck support portion can be stored within the pillow body.

SUMMARY

A dual compartment zipper adjustable pillow includes a main body portion and a neck support portion. The pillow can be used with the neck support portion inside or outside of the main body portion. The pillow is configured having dual compartments, and can be used in a single or dual compartment configuration.

In an embodiment, the main body portion has front and rear panels, defining four sides and is sealed along three of the sides, leaving the fourth side openable. The main body portion defines an interior space.

The neck support portion is connected to the main body portion at a location adjacent to the fourth openable side. A full open end zipper defines first and second zipper portions disposed on the front panel of the main body portion. The zipper portions are on opposing sides of the opening and can be opened to access the interior space and zipped closed to enclose or seal the man body portion.

One half of a full open zipper defines a third zipper portion that is disposed on a rear side of the neck support portion. In a dual compartment configuration, the neck support portion is outside of the main body portion interior space and the first and second zipper portions are closed to enclose the main body portion. In a single compartment configuration, the neck support portion is positioned in the main body portion interior and the first and third zipper portions are closed to enclose the main body portion.

In an embodiment, a zipper pull is positioned on the first zipper portion. The zipper pull joins the first and second zipper portions when in the dual compartment configuration and joins the first and third zipper portions when in the single compartment configuration. In an alternate embodiment, a first zipper pull is located on the second zipper portions and a second zipper pull is located on the third zipper portion. The first zipper pull joins the first and second zipper portions when in the in the dual compartment configuration and the second zipper pull joins the first and third zipper portions when in the single compartment configuration.

The neck support portion can include a closure for accessing an interior of the neck support portion to, for example, access the fill in the neck support portion. The closure can be, for example, a zipper.

In an embodiment, the front and rear panels of the main body portion are separate elements that are joined to one another along the three sides. The main body portion and neck support portion can be formed from a single element.

An embodiment of a dual compartment zipper adjustable pillow includes a main body portion defining an interior. The main body portion has an opening therein to access the interior. A full open end zipper is configured to close the opening. The full open end zipper has first and second zipper portions closeable with one another and fully separable from one another.

A neck support portion is adjacent and connected to an edge of the main body portion. The neck support portion has one half of a full open end zipper. The one half of the full open zipper is a third zipper portion. In a dual compartment configuration, the neck support portion is outside of the main body portion interior and the first and second zipper portions are closed to enclose the main body portion. And, in a single compartment configuration, the neck support portion is positioned in the main body portion interior and the first and third zipper portions are closed to enclose the main body portion.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
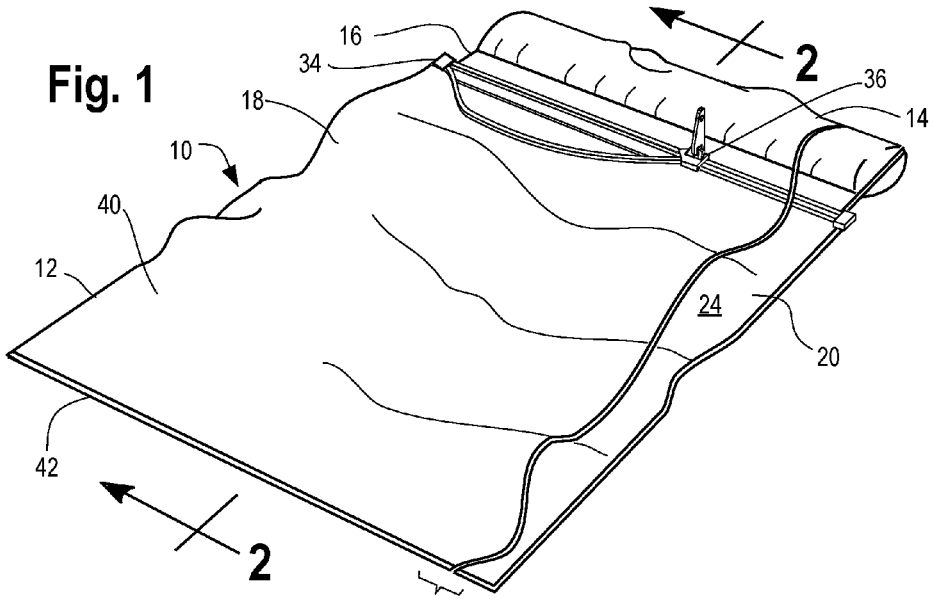
FIG. 1 is a perspective view of an example of a dual compartment zipper adjustable pillow according to an embodiment disclosed herein, the pillow being shown partially broken away.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring now to the figures and in particular to FIG. 1, there is shown a perspective view of a dual compartment zipper adjustable pillow 10 according to an embodiment described herein. The pillow 10 includes a main body portion 12 and a neck support portion 14. In an embodiment the main body portion 12 and the neck support portion 14 are formed integral with or joined to one another, as by stitching. The pillow 10 can include an intermediate portion 16 bridging the main body portion 12 and the neck support portion 14.

The main body portion 12 can have, for example, a rectangular shape that includes front and rear panels 18, 20 joined to one another along three of the four sides 22*a,b,c*. The fourth side 22*d* of the main body portion 12 is openable to access an interior space 24. The neck support portion 14 can be sealed or can include a closable opening, closable by, for example, a zipper (not shown) to allow access to the interior 26 of the neck support portion 14. Both the main body portion 12 and the neck support portion 14 can include a filler material F, such as a foam filler material, a feather/down filler material or other suitable pillow filler materials as will be recognized by those skilled in the art.

Figure 5:
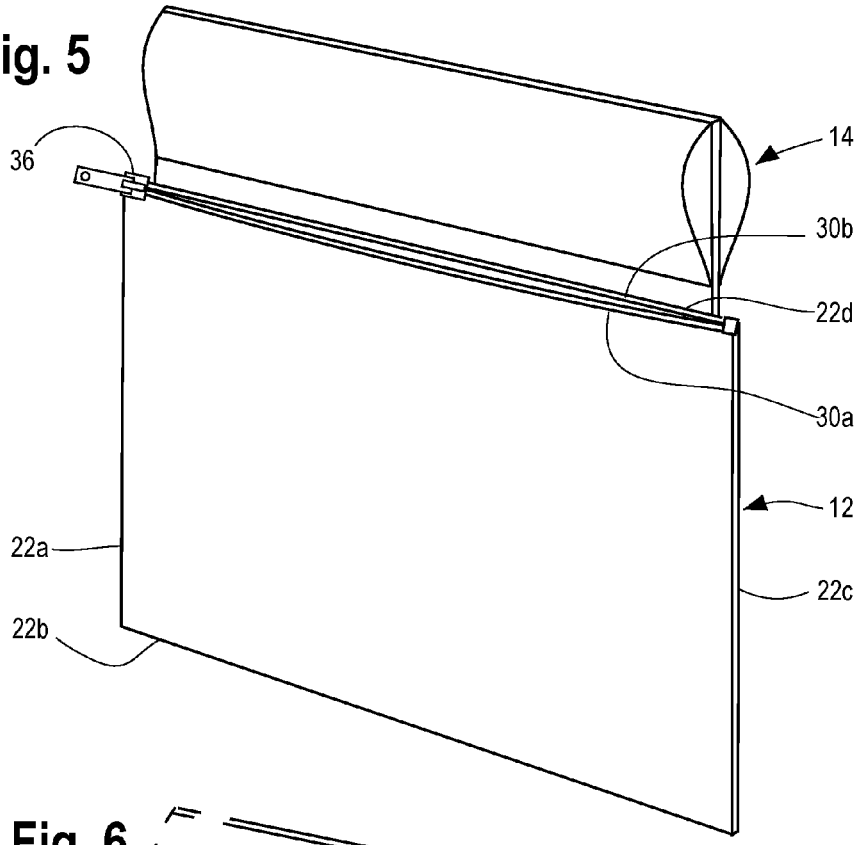
FIG. 5 is a schematic illustration of the pillow in the expanded condition.
Figure 6:
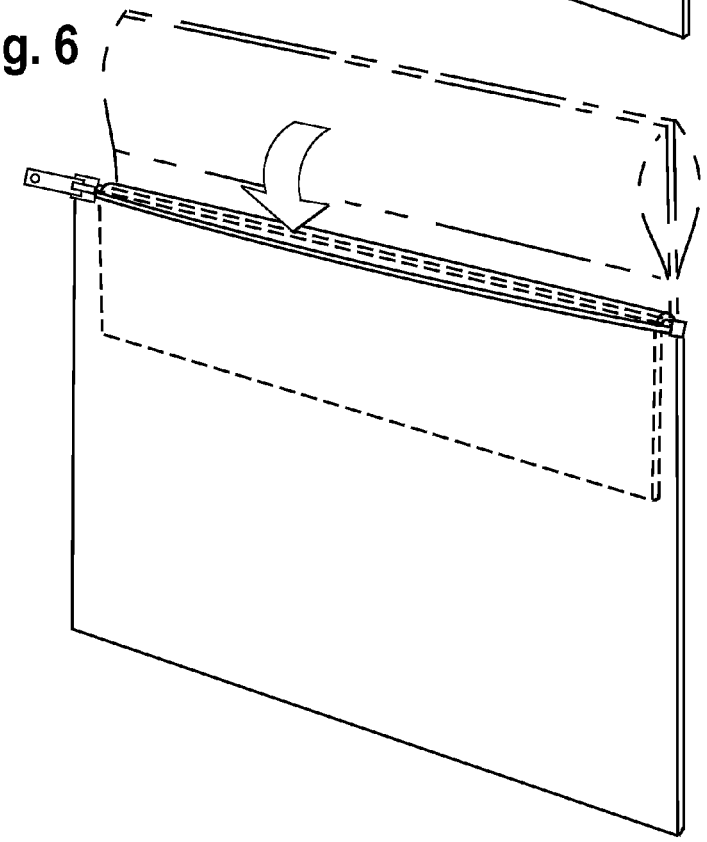
FIG. 6 is a schematic illustration of the pillow with the neck support portion being tucked into the main body portion.
Figure 7:
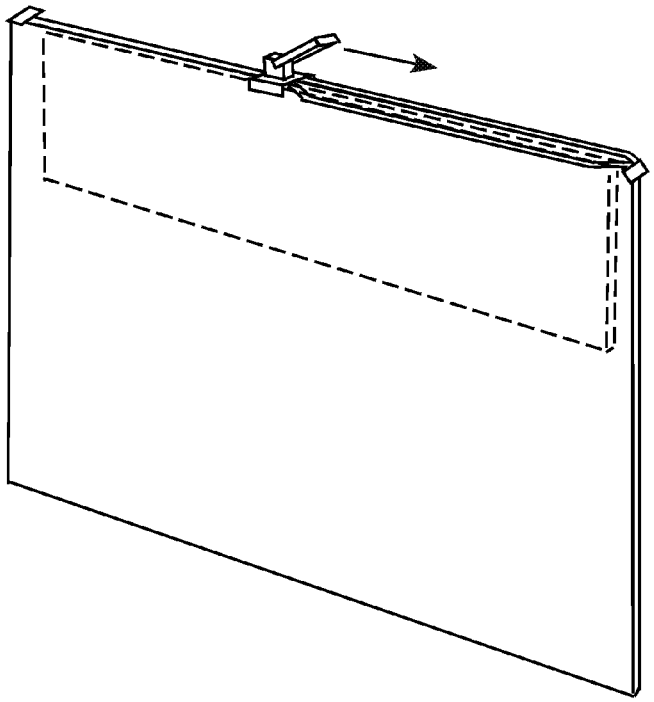
FIG. 7 is a schematic illustration of the zipper being closed to enclose the neck support portion in the main body portion.
Figure 8:
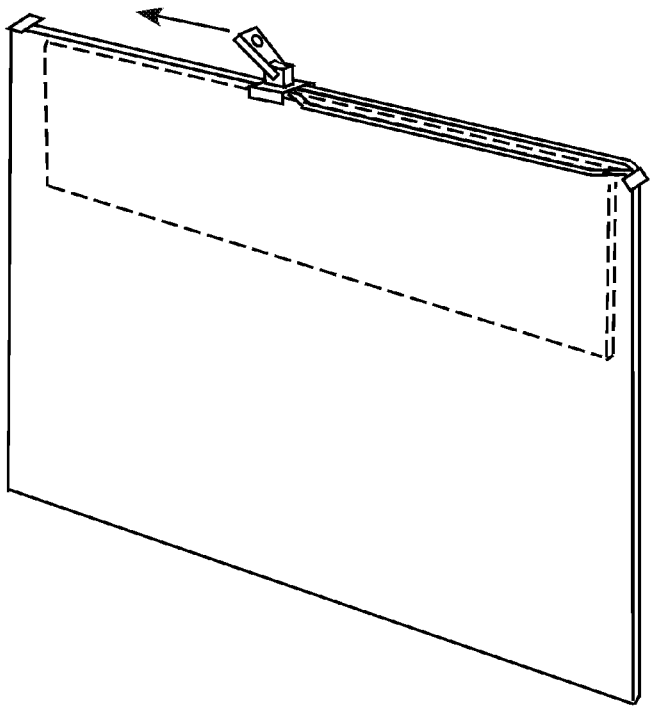
FIG. 8 is a schematic illustration of the zipper being opened on the main body portion.
Figure 9:
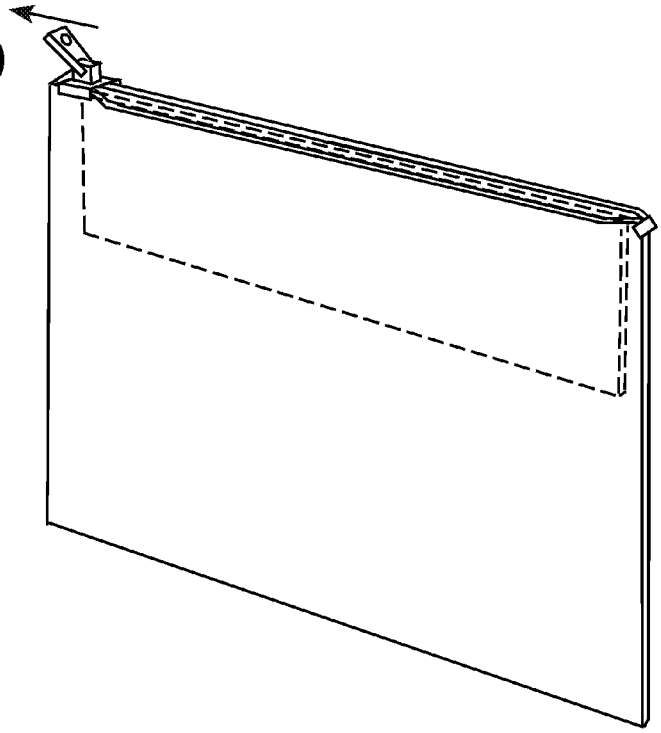
FIG. 9 is a schematic illustration of the zipper on the main body portion fully opened.
Figure 10:
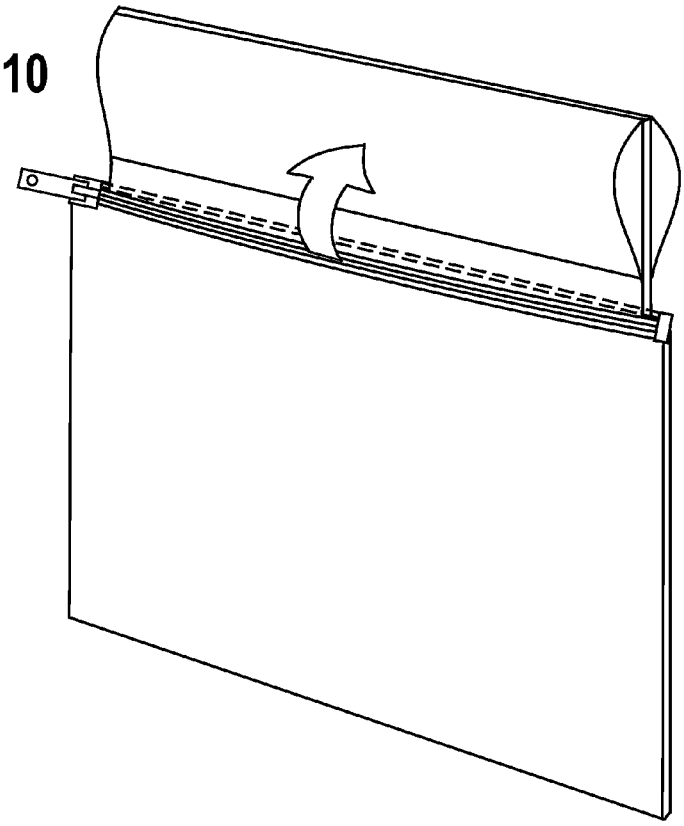
FIG. 10 is a schematic illustration of the neck support portion being removed from the main body portion.
Figure 11:
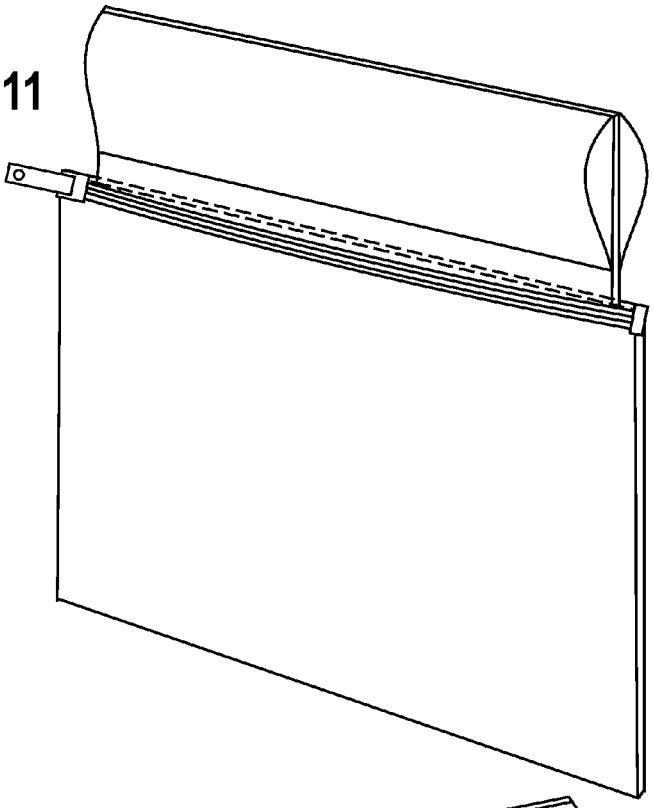
FIG. 11 is a schematic illustration of the neck support portion fully removed from the main body portion and the main body portion closed by the zipper.

The pillow 10 is configured such that the main body portion 12 and the neck support portion 14 can be used as two pillows joined to one another (a dual compartment configuration, as seen in FIG. 5) or the neck support portion 14 can be inserted into the main body portion 12 (a single compartment configuration, as seen in FIG. 7) to provide additional support as desired. When used as two pillows (the dual compartment configuration) the space 28 between the neck support portion 14 and the main body portion 12 can be used to, for example, cradle the user's head.

To effect the change between the single and dual compartment configurations, the pillow 10 includes one full open end or jacket type zipper 30 and one-half of an open-end or jacket type zipper 32. It will be recognized by those skilled in the art that an open-end or jacket type zipper 30 is a zipper in which the two zipper portions 30*a,b* are fully separable from one another. Such a zipper 30 typically includes a retaining box 34 affixed to one-half of the zipper (on one of the zipper tapes, for example, 30*a*) and an insert pin (not shown) on the other half of the zipper (on the opposite zipper tape, for example, 30*b*). A zipper slider 36 is retained on the tape 30*a* with the retaining box 34 to prevent removing the slider 36 from the zipper portion or tape 30*a*. For purposes of the present disclosure, reference will be made to first, second and third zipper portions 30*a*, 30*b* and 32.

Figure 2:
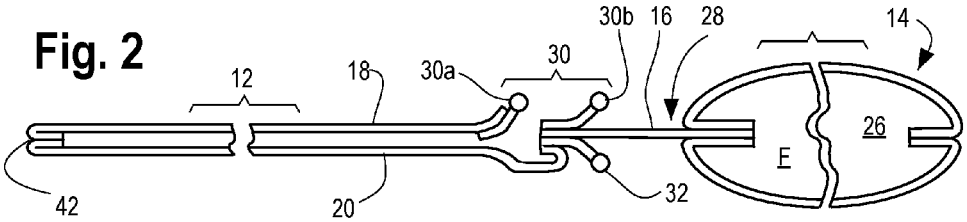
FIG. 2 is a side sectional illustration the pillow of FIG. 1, taken along line 2-2 of FIG. 1 in a first or expanded condition.

As illustrated in FIG. 2, the full zipper or the first and second zipper portions 30*a,b* are provided on the main body portion 12 and are used to open and close the main body portion 12 to access the interior volume 24 or close the main body portion 12. Because open-end zippers 30 are used, the first and second zipper portions 30*a,b* can be fully separated from each other. In the dual compartment configuration, the first and second zipper portions 30*a,b* are joined to one another, thus closing the main body portion 12 with the neck support portion 14 outside of the main body portion 12.

Figure 3:
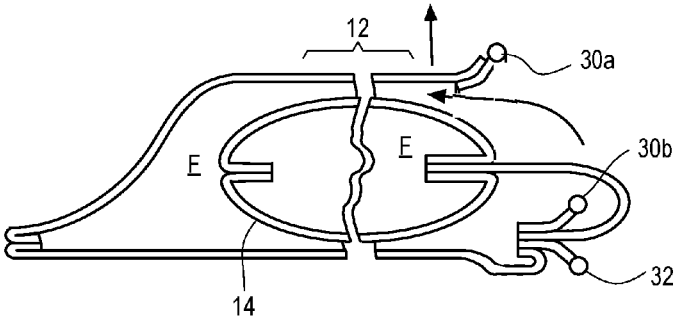
FIG. 3 is a side sectional view similar to FIG. 2, but showing the neck support portion as it is inserted into the main body of the pillow.
Figure 4:
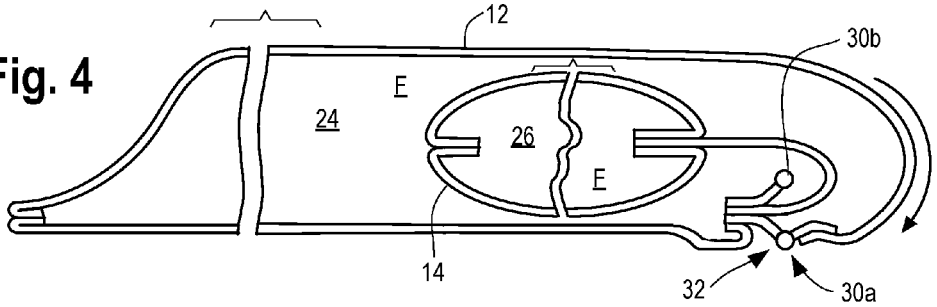
FIG. 4 is another side sectional view similar to FIGS. 2 and 3, but showing the neck support portion inserted into the main body portion and with the zipper enclosing the neck support portion in the main body portion.

When it is desired to change to the single compartment configuration, the first and second zipper portions 30*a,b* are fully separated from one another (opening the main body portion 12). In this state, the first and second zipper portions 30*a,b* are completely separated from one another (see, FIG. 2). The neck support portion 14 is inserted into the main body portion 12, as shown in FIG. 3. The first and third zipper portions 30*a*, 32 are then joined to one another and the zipper (first and third zipper portions 30*a*, 32) are closed, to enclose the main body portion 12 with the neck support portion 14 inside of the main body portion 12.

Zipper sliders 36 can be positioned in a number of configurations. In one embodiment, a zipper slider 36 is positioned on the first zipper portion 30*a*. In this configuration, in the dual compartment configuration, the zipper slider 36 is used to join the first and second zipper portions 30*a*, 30*b* with the neck support portion 14 outside of the main body portion 12. When changed to the single compartment configuration (the neck support portion 14 is inserted into the main body portion 12), the first and third zipper portions 30*a*, 32 are joined to one another using the single zipper slider 36.

Figure 12:
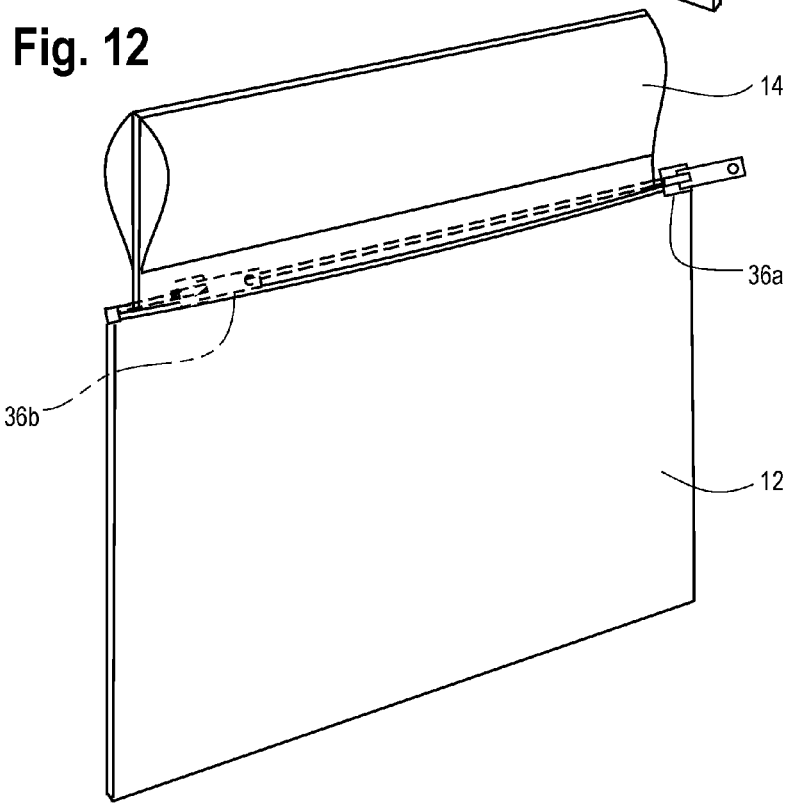
FIG. 12 illustrates an embodiment of the pillow using two zipper pulls.

In another configuration, as seen in FIG. 12, zipper sliders 36*a*, 36*b* are positioned on the second and third zipper portions 30*b*, 32. In this configuration, in the dual compartment configuration, the zipper slider 36*a* on the second zipper portion 30*b* is used to join the first and second zipper portions 30*a*, 30*b* with the neck support portion 14 outside of the main body portion 12. When changed to the single compartment configuration (the neck support portion 14 is inserted into the main body portion 12), the zipper slider 36*b* on the third zipper portion 32 is used to join the first and third zipper portions 30*a*, 32 to one another with the neck support portion 14 inside the main body portion 12.

It will be appreciated by those skilled in the art that other zipper 30, 32 configurations can be used to achieve the dual compartment adjustable pillow 10 configuration. It will also be appreciated that although the neck support portion 14 is shown as a sealed pillow, it too can include a closure, such as a zipper (not shown) to allow the amount and type of fill to be adjusted or changed, as desired.

There are also a number of ways in which the pillow shell 40 can be fabricated. For example, a single piece of material can be used that is folded over at the bottom 42 of the shell 40, up to and terminated at the first zipper portion 30*a* to form the front panel 18. The rear panel 20 can extend up to and form the neck support portion 14 (which can be sealed by stitching) and folded downward, toward and to the second zipper portion 30*b*. The third zipper portion 32 can then be sewn or stitched to the rear panel 20. Alternately, the main body portion 12 and neck support portion 14 can be fabricated as separate elements and joined to one another.

It will also be appreciated that although the pillow 10 is shown as a "flat" pillow (that is the front and rear panels 18,

20 are joined, e.g., by stitching, directly to one another, the front and rear panels 18, 20 can be joined with a gusset panel (not shown) between the front and rear panels 18, 20.

It will be appreciated by those skilled in the art that the relative directional terms such as top, bottom, sides, front, rear and the like are for explanatory purposes only and are not intended to limit the scope of the disclosure. All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing, it should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A dual compartment zipper adjustable pillow comprising:

a main body portion having front and rear panels, the main body portion having four sides and being sealed along three of the sides, the main body portion defining an interior space;

a neck support portion connected to the main body portion at a location adjacent to the fourth side;

a full open end zipper defining first and second zipper portions disposed on the front panel of the main body portion and openable to access the interior space; and one half of a full open zipper defining a third zipper portion disposed on a rear side of the neck support portion, wherein in a dual compartment configuration, the neck support portion is outside of the main body portion interior space and the first and second zipper portions are closed to enclose the main body portion and in a single compartment configuration, the neck support portion is positioned in the main body portion interior and the first and third zipper portions are closed to enclose the main body portion.

2. The pillow of claim 1 including a zipper pull positioned on the first zipper portion.

3. The pillow of claim 1 including zipper pulls located on the second and third zipper portions.

4. The pillow of claim 1 wherein the neck support portion includes a closure for accessing an interior of the neck support portion.

5. The pillow of claim 4 wherein the closure is a zipper.

6. The pillow of claim 1 wherein the front and rear panels of the main body portion are separate elements joined to one another along the three sides.

7. The pillow of claim 1 wherein the main body portion and neck support portion are formed from a single element.

8. The pillow of claim 1 including a filler in the main body portion.

9. A dual compartment zipper adjustable pillow comprising:

a main body portion defining an interior, the main body portion having an opening therein to access the interior, the main body portion having a full open end zipper configured to close the opening, the full open end zipper having first and second zipper portions closeable with one another and fully separable from one another; and a neck support portion adjacent and connected to an edge of the main body portion, the neck support portion have one half of a full open end zipper, the one half of the full open zipper being a third zipper portion, wherein in a dual compartment configuration, the neck support portion is outside of the main body portion interior and the first and second zipper portions are closed to enclose the main body portion and in a single compartment configuration, the neck support portion is positioned in the main body portion interior and the first and third zipper portions are closed to enclose the main body portion.

10. The pillow of claim 9 including a zipper pull positioned on the first zipper portion.

11. The pillow of claim 9 including zipper pulls located on the second and third zipper portions.

12. The pillow of claim 9 wherein the neck support portion includes a closure for accessing an interior of the neck support portion.

13. The pillow of claim 12 wherein the closure is a zipper.

14. The pillow of claim 9 wherein the main body portion is formed from front and rear panels joined to one another, in part, to define the opening.

15. The pillow of claim 9 wherein the main body portion and neck support portion are formed from a single element.

16. The pillow of claim 9, wherein the pillow has a rectangular shape.

* * * * *